US012523045B2

(12) United States Patent
Gutkowski

(10) Patent No.: US 12,523,045 B2
(45) Date of Patent: Jan. 13, 2026

(54) JOINT OF FLOOR PANELS

(71) Applicant: "BARLINEK" SPÓLKA AKCYJNA, Kielca (PL)

(72) Inventor: Pawel Gutkowski, Barlinek (PL)

(73) Assignee: "BARLINEK" SPÓŁKA AKCYJNA, Keilce (PL)

( * ) Notice: Subject to any disclaimer, the term of this patent is extended or adjusted under 35 U.S.C. 154(b) by 279 days.

(21) Appl. No.: 18/547,000

(22) PCT Filed: Apr. 11, 2022

(86) PCT No.: PCT/IB2022/053386

§ 371 (c)(1),
(2) Date: Aug. 18, 2023

(87) PCT Pub. No.: WO2022/224078

PCT Pub. Date: Oct. 27, 2022

(65) Prior Publication Data

US 2024/0141655 A1 May 2, 2024

(30) Foreign Application Priority Data

Apr. 19, 2021 (PL) ..... 437615

(51) Int. Cl.
*E04F 15/00* (2006.01)
*E04F 15/02* (2006.01)

(52) U.S. Cl.
CPC *E04F 15/02038* (2013.01); *E04F 2201/0547* (2013.01)

(58) Field of Classification Search
CPC ..... E04F 15/02033; E04F 15/02038; E04F 15/107; E04F 15/102; E04F 15/105;
(Continued)

(56) References Cited

U.S. PATENT DOCUMENTS 7,908,815 B2 * 3/2011 Pervan ..... E04F 15/10 52/391
10,837,181 B2 * 11/2020 Josefsson ..... E04F 13/0894
(Continued)

FOREIGN PATENT DOCUMENTS

WO WO2008004960 A2 1/2008
WO WO201420913 A1 12/2014
WO WO2016155696 A1 6/2016

*Primary Examiner* — Chi Q Nguyen
(74) *Attorney, Agent, or Firm* — Renner, Kenner, Grieve, Bobak, Taylor & Weber, Co. LPa

(57) ABSTRACT

A floor panel system comprises a joint of floor panels wherein each of the floor panels is a rectangular plate with upper and lower surfaces, two long and two short edge side surfaces, and a longitudinal coupling element extending horizontally beyond the upper surface and includes a settling recess that couples with a downwardly extending projection of an adjacent panel, forming a horizontal retaining assembly, a bearing surface at the end of the coupling element which is away from a bearing surface of the adjacent panel, and a bearing projection between the bearing surfaces to form a second vertical retaining assembly and define a lower expansion joint. The panels are joined at the long and short edges using the first vertical retaining assembly and the second vertical retaining assembly via a bearing protrusion integrated into the panel and a having a height greater than the size of the lower dilation gap. Further, the longitudinal coupling element has an upwardly extending vertical projection placed in a settling seat below the guiding groove of the elastic insert.

7 Claims, 5 Drawing Sheets

(58) Field of Classification Search
CPC ..... E04F 13/18; E04F 2201/042; E04F 2201/0107; E04F 2201/03; E04F 2201/0547; E04F 2201/0552; E04F 2201/023; E04F 2201/0535; E04F 2201/0146; E04F 2201/043; E04F 2201/0153; E04F 2201/0138; B44C 5/04; E04B 9/045; B32B 7/022; B32B 3/06; B32B 5/18; B32B 2307/7376; B32B 2266/0214; B32B 2307/54; B32B 2419/00; B32B 2451/00; B44F 9/04
See application file for complete search history.

(56) References Cited

U.S. PATENT DOCUMENTS

| | | | | |
|---|---|---|---|---|
| 11,352,799 | B2 * | 6/2022 | Boucké | B32B 27/08 |
| 11,359,384 | B2 * | 6/2022 | Markovski | E04F 15/02038 |
| 11,608,646 | B2 * | 3/2023 | Schäfers | E04F 15/102 |
| 11,708,698 | B2 * | 7/2023 | Drevet | E04F 13/0894 52/588.1 |
| 12,110,693 | B1 * | 10/2024 | Devos | E04F 15/082 |
| 12,221,793 | B1 * | 2/2025 | Devos | B05D 7/08 |
| 2007/0130872 | A1 * | 6/2007 | Goodwin | E04F 15/02 52/592.1 |
| 2011/0131909 | A1 * | 6/2011 | Hannig | E04F 15/02 52/309.1 |
| 2011/0138722 | A1 * | 6/2011 | Hannig | E04F 15/02033 52/309.1 |
| 2020/0131784 | A1 * | 4/2020 | Boucké | E04F 13/18 |
| 2021/0370109 | A1 * | 12/2021 | Brady | A62B 23/06 |

* cited by examiner

JOINT OF FLOOR PANELS

TECHNICAL FIELD

The subject of the invention is a joint of floor panels, especially intended for joining short edges of a panel with long edges of an adjacent panel. The invention is applicable to hardwood floor panels, engineered wood floor panels, laminated wood-based material panels and floor panels manufactured from conglomerates of different materials.

BACKGROUND ART

From WO03016654, a joint for rectangular floor panels is known which comprises longitudinal coupling elements parallel to the upper surface and extending horizontally beyond the upper surface. Furthermore, the longitudinal coupling elements have settling recesses that couple with the protrusions of adjacent floor panels. The coupled panels form together a horizontal retaining assembly and a vertical retaining assembly. Furthermore, the longitudinal coupling element has a bearing surface at its end which is remote from the bearing surface of the adjacent floor panel, thus forming an expansion joint. In particular, a known floor panel joint, in an alternative solution, has a vertical retaining assembly with a blocking assembly using an additional element having a circular cross-section.

Floor panels, especially those made of wood, are not resistant to changes in moisture and changes in temperature. Microclimatic changes cause the wood to swell or dry out, which alters its dimensions. The percentage change in dimensions of individual wood layers of a floor panel is strongly dependent on the fibre orientation. Wood of species commonly used in the production of floor panels can, with a longitudinal fibre orientation change its dimensions in terms of swelling/shrinkage by about 0.5%, whereas with a radial or tangential fibre orientation, wood dimensions can change by up to 9%. In contrast, the compression resistance of wood in the radial or tangential direction is about five times lower and equals approximately 8 MPa compared to approximately 50 MPa for the longitudinal direction. The high compression resistance for the longitudinal direction is associated with the increased brittleness of the wood, which results in local splinter damage to the wood fibres near the edges of the short sides when the wood swells in the floor panels. On the other hand, in the case of a radial or tangential fibre arrangement, the low pressure resistance associated with ductility can cause plastic deformation known as edging. To prevent damage to the panels due to swelling of the wood when exposed to moisture, it is necessary to design a suitable expansion joint at the contact points of the edges to be joined of the upper layers.

Furthermore, the floor panel joints use elastic inserts as the main component of the vertical retaining assembly. When joining such known floor panels, bending or warping of the elastic inserts may occur. The change in shape of elastic inserts is usually caused by their striking or rubbing against the edges or side surfaces of the adjacent floor panel during joining of the panels with the use of a semi-rotational movement about their longitudinal axis or as a result of joining induced by vertical pressure. As a result of such a phenomenon, difficulties may arise in fitting the elastic insert into the settling recess, which to some extent hinders the task of vertical retaining of the floor panels being joined together.

The purpose of the invention is to develop a floor panel joint, the design of which facilitates the vertical retaining operation and increases the resistance of the joint to the effects of wood swelling and drying out.

Another purpose of the invention is to obtain an increased dimensional stability of the upper expansion joint at the contact points of the edges to be joined of the floor panels.

DISCLOSURE OF INVENTION

In the floor panel joint according to the invention, each of the floor panels to be joined is in the form of a rectangular plate, each plate comprising

- an upper surface and a lower surface parallel to it, intended to be laid on the substrate,
- two long edges of side surfaces,
- two short edges of side surfaces,
- a first vertical retaining assembly for the floor panels to be joined, in the form of an elastic insert placed between the floor panels to be joined, and
- a longitudinal coupling element shaped below the long edge of the side surface.

The longitudinal coupling element is parallel to the upper surface and extends horizontally beyond this upper surface, and furthermore, the longitudinal coupling element has a settling recess that couples with the downwardly extending protrusion of the adjacent floor panel and forms with it a horizontal retaining assembly of the floor panels to be joined.

The longitudinal coupling element has a bearing surface at its end which is remote from the bearing surface of the adjacent floor panel.

Furthermore, a bearing projection is placed between the bearing surfaces and forms vertical retaining assembly, and defines a lower expansion joint.

The solution according to the invention is characterised in that the floor panel is joined by a long edge to a short edge of an adjacent floor panel,

- by means of the said first vertical retaining assembly in the form of an elastic insert, placed via sliding in a guiding groove between the floor panels to be joined and extending from the side surface below the short edge,
- and by means of a second vertical retaining assembly, placed below the first vertical retaining assembly, in the form of a bearing protrusion extending from the bearing surface, which bearing surface is positioned partially in a groove formed in the bearing surface of the adjacent floor panel, the bearing protrusion being an integral part of the floor panel and having a height greater than the size of the lower expansion joint,
- and furthermore, the longitudinal coupling element has an upwardly extending vertical projection placed in a settling seat below the guiding groove of the elastic insert.

Preferably, the bearing projection is in the form of a cylindrical section, and the groove of the adjacent floor panel is adapted in shape to receive a part of this bearing projection.

Preferably, the groove is formed in a downwardly extending tongue of the adjacent floor panel.

Preferably, the bearing surface of the downwardly extending tongue of the adjacent floor panel is inclined from the vertical by an angle between 1° and 5°.

Preferably, the downwardly extending projection has two convex arched surfaces matching two concave arched surfaces of the settling recess.

Preferably, the two concave arched surfaces form an elongated hump at their contact point and the two convex arched surfaces form a recess at their contact point, with the elongated hump being adapted in shape to the recess.

Preferably, the floor panel has a slanted bearing surface above the settling recess, intended for contacting the elastic insert, wherein this slanted bearing surface is positioned above the lower surface of the settling recess and a free space is left between the lower side of the elastic insert and the lower surface of the settling recess.

The use of the longitudinal bearing projection located partially in the groove of the adjacent floor panel is of significant importance in case of a temporary increase in moisture in the lower zones of the joined floor panels. When these lower zones swell, there is a preliminary spreading of the panels by the swelling layers located in the lower and middle parts of the panels before swelling of the outer layer around the upper surface. Such a preliminary spreading of the lower layers prevents the pressure-resistant yet brittle surface layers of the floor panels from damaging each other.

Obtaining a bearing projection with a height greater than the size of the lower expansion joint is achieved by partially inserting this bearing projection into the groove of the adjacent floor panel. Such a coupling between the longitudinal bearing protrusion and the groove of the adjacent floor panel results in an increased effectiveness of horizontal retaining and vertical retaining of the joined floor panels, thus increasing the stability of the joint.

The execution of the longitudinal bearing protrusion in the form of an integral part of the floor panel has a significant effect on achieving a greater dimensional accuracy, and therefore has a beneficial effect on the possibility of reducing and stabilising the width of the upper expansion joint between the side surfaces of the floor panels to be joined. Such an integrated bearing protrusion also facilitates the joining of floor panels and, in particular, protects against possible deformation of the damage-sensitive elements of the first vertical retaining assembly, without the need for additional separating elements.

The angular inclination of the bearing surface of the downwardly extending tongue of the adjacent floor panel facilitates guidance of the longitudinal bearing projection for settling in the groove of the adjacent floor panel. In particular, such a guidance is facilitated when the bearing projection is in the form of a cylindrical section, and the groove of the adjacent floor panel is adapted in shape to receive a part of this longitudinal bearing projection.

Leaving a free space between the lower side of the elastic insert and the lower surface of the settling recess allows the elastic insert to move freely between the panels to be joined. Such a design prevents detrimental bending of the elastic insert during installation, which facilitates vertical retention. Leaving this clearance between the lower side of the elastic insert and the lower surface of the settling recess also makes it possible to increase the tolerance of the pressing force exerted on the panels to be joined. If the pressing force is increased, the elastic insert will not bend. The elastic insert will not be jammed either in the guiding groove when pressing too hard on the adjacent floor panel, as the longitudinal coupling element will be moved downwards via the second vertical retaining assembly. Thus, coupling the bearing protrusion with the groove of this pressed adjacent floor panel will prevent the elastic insert from jamming in the guiding groove under increased installation pressure.

BRIEF DESCRIPTION OF THE DRAWINGS

The subject of the invention is shown in embodiments in the drawing, in which.

DETAILED DESCRIPTION OF THE DRAWINGS

Figure 1:
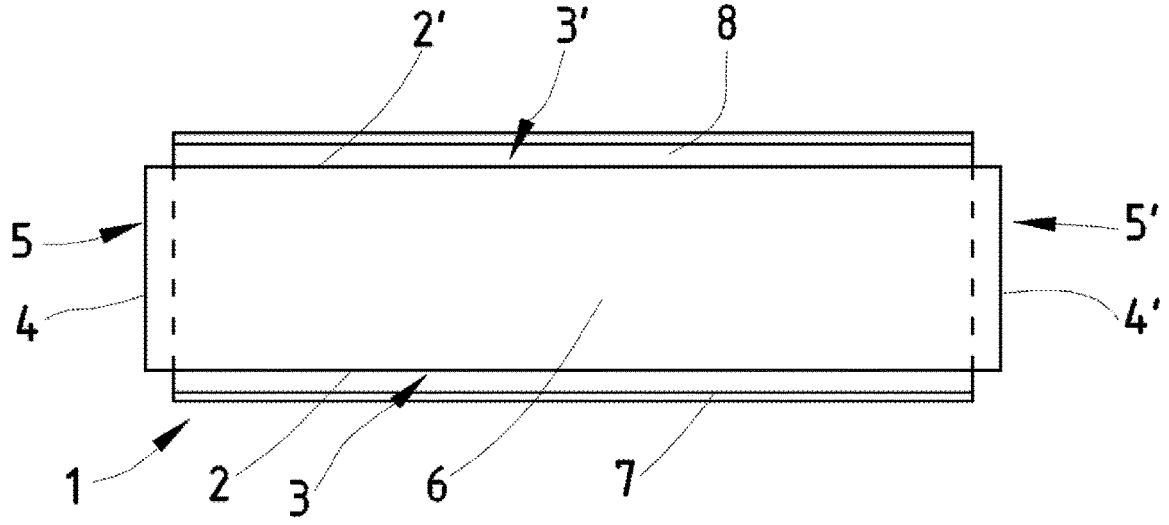
FIG. 1 shows a floor panel in a top view.

FIG. 1 illustrates a floor panel 1 having two long edges 2, 2', parallel to each other, of side surfaces 3, 3' and two short edges 4, 4', parallel to each other, of side surfaces 5, 5'. The long edges 2, 2' and the short edges 4, 4' define a rectangular area of an upper surface 6 of the floor panel 1. Two longitudinal coupling elements 7, 8 project laterally beyond this upper surface 6 and are parallel to each other and parallel to the upper surface 6 of the floor panel 1.

Figure 2:
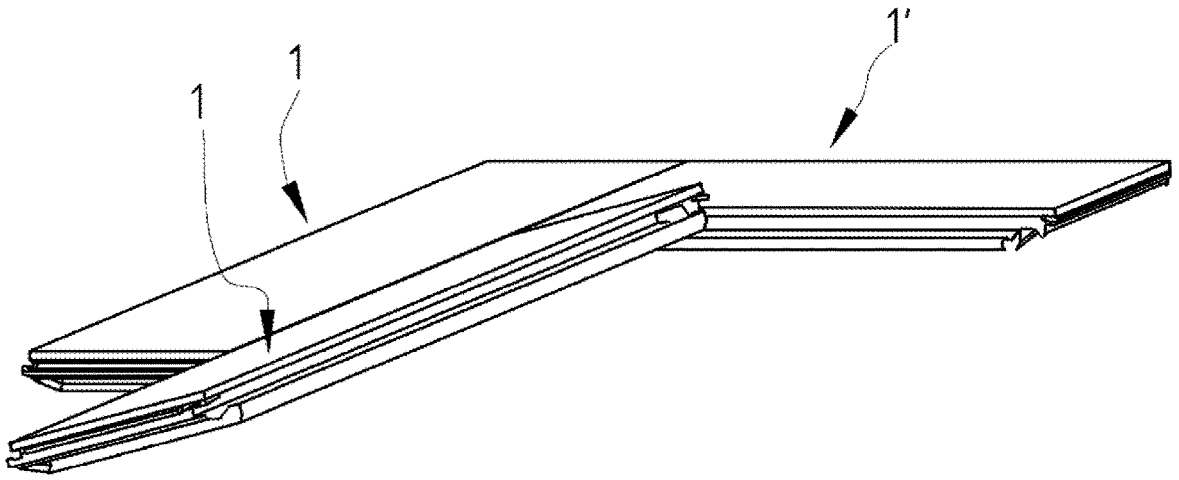
FIG. 2 floor panels laid in herringbone pattern in an axonometric view.

FIG. 2 shows three identical floor panels 1, 1' during a herringbone laying operation. The floor panels 1, 1' are joined by partial rotation and pressure.

Figure 3:
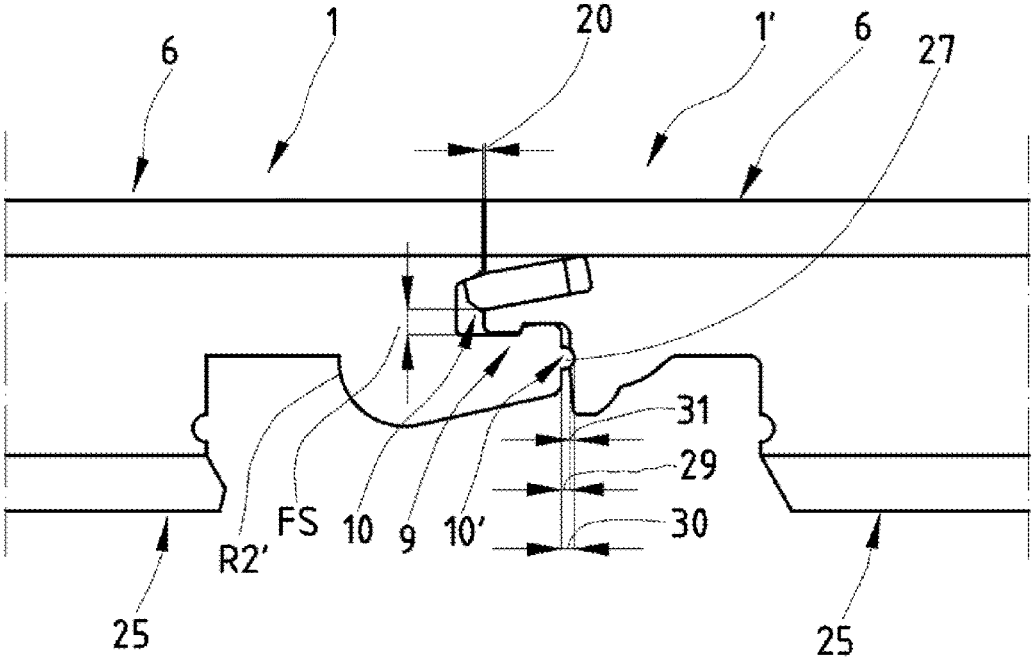
FIG. 3 floor panels in a joined position, forming a joint between perpendicularly laid floor panels, where the long edge of the floor panel is joined to the short edge of the adjacent floor panel.
Figure 4:
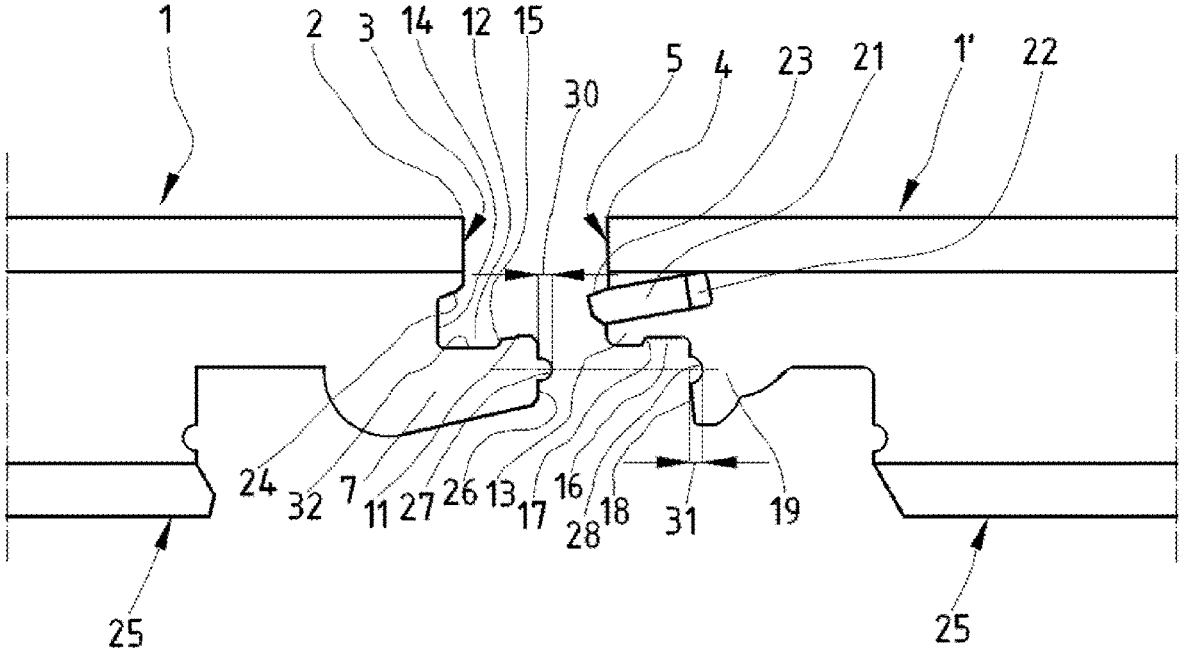
FIG. 4 floor panels, intended to form the floor panel joint shown in FIG. 3, placed side by side.

The floor panels 1 may join perpendicularly to each other to form a joint of the identical floor panels 1, 1'. As shown in FIG. 3 and FIG. 4, such a joint of the floor panels 1, 1' constitutes a perpendicular arrangement in which the long edge 2 of the floor panel 1 is joined to the short edge 4 of the adjacent floor panel 1'. The joining of these floor panels 1, 1' is carried out by a horizontal retaining assembly 9 and a first vertical retaining assembly 10, and a second vertical retaining assembly 10'.

The longitudinal coupling element 7 has in its lower part a convex arched surface R2' intended to be connected to the fasteners of the second longitudinal coupling element 8.

The horizontal retaining assembly 9 is formed by an upwardly extending vertical projection 11 formed at the end of the longitudinal coupling element 7 of the floor panel 1. The vertical projection 11 forms a settling recess 12, located in the upper horizontal part of the longitudinal coupling element 7, adapted to receive a downwardly extending vertical projection 13 of the adjacent floor panel 1'. The settling recess 12 is limited on one side by a vertical surface 14 and on the other side by a diagonal bearing surface 15 of the upwardly extending vertical projection 11. In turn, the downwardly extending vertical projection 13 of the adjacent floor panel 1' forms a settling seat 16 located between a diagonal bearing surface 17 and a vertical bearing surface 18 of a downwardly extending tongue 19.

In the joined position of the floor panel 1 with the adjacent floor panel 1', the horizontal retaining assembly 9 makes it possible to obtain a predetermined size of an upper expansion joint 20 between the long edge 2 of the side surface 3 and the short edge 4 of the side surface 5.

The first vertical retaining assembly 10 of the floor panels 1, 1' to be joined is formed in this embodiment by an elastic insert 21 placed via sliding in a guiding groove 22 from the side surface 5, the guiding groove 22 being located above the settling seat 16. Floor panels 1, 1' are joined by, essentially, vertically pressing the adjacent floor panel 1' in order to flush the upper surfaces 6 of the adjacent floor panels 1, 1'. In the flush position, the upper part 23 of the resilient insert 21 extending from the guiding groove 22 remains in contact with the slanted bearing surface 24 formed between the vertical surface 14 and the side surface 3. In this position, lower surfaces 25 of the joined floor panels 1, 1' are also aligned in a single plane.

The longitudinal coupling element 7 has a vertical retaining surface 26 from which a longitudinal bearing projection 27 in the shape of a cylindrical section protrudes, forming an integral part of the said longitudinal coupling element 7. In the joined position of the floor panel 1 with the adjacent floor panel 1', the longitudinal bearing projection 27 is located partially in a groove 28 formed in the vertical bearing surface 18 of the downwardly extending tongue 19 of the adjacent floor panel 1'. A lower expansion joint 29 is provided between the bearing surfaces 18, 26, wherein the bearing projection 27 has a height 30 which is greater than the size of the lower expansion joint 29 because, in the joined position of the floor panels 1, 1', the end part of the bearing projection 27 is placed in the groove 28 of the adjacent floor panel 1' at a depth 31. This means that with the panels 1, 1' joined, the lower expansion joint 29 is smaller than the height 30 of the bearing protrusion 27 by the depth of the groove 28 of the adjacent floor panel 1'.

The longitudinal bearing protrusion 27 thus made, being an integral part of the longitudinal coupling element 7, intended to be placed in the groove 28 of the adjacent floor panel 1', constitutes the second vertical retaining assembly 10' of the floor panels 1, 1' to be joined. This configuration is also important for increasing the precision of joining the floor panels 1, 1'.

In the embodiment shown in FIG. 3 and FIG. 4, the distance between the bearing surface 24 and the lower surface 32 of the settling recess 12 is substantially greater than the thickness of the elastic insert 21. Placing the longitudinal bearing protrusion 27 in the groove 28 of the adjacent floor panel 1' and providing a free space FS between the elastic insert 21 and the lower surface 32 of the settling recess 12 allows a larger pressing force tolerance to be applied when joining the panels 1, 1'. When a higher pressing force is applied, the elastic insert 21 does not engage in the guiding groove 22, nor does it deform due to contact with adjacent surfaces, and can move without increased frictional resistance to ensure proper vertical retention of the floor panels 1, 1' to be joined.

Figure 5:
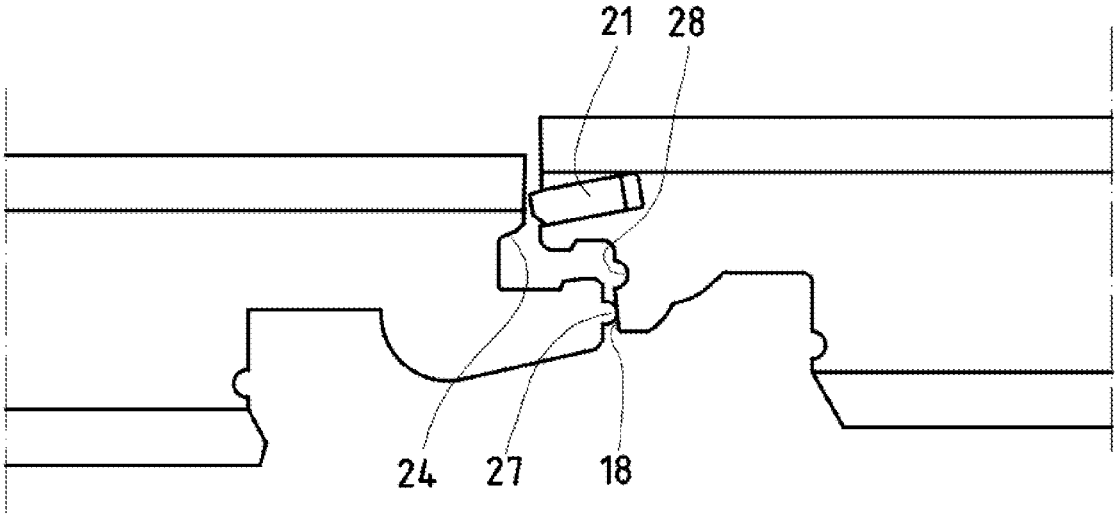
FIG. 5 floor panels from FIG. 4 in position during the joining operation.

During installation of the panels 1, 1', the bearing projection 27 is guided by the lower part of the vertical bearing surface 18, whereby, in such an installation position as shown in FIG. 5, the guidance of the elastic insert 21 is facilitated. This configuration of the bearing protrusion 27 and the vertical bearing surface 18 during installation protects the elastic insert 21 from damage. By guiding the bearing projection 27 into the groove 28 of the adjacent floor panel 1', the position shown in FIG. 3 is obtained, in which the upper part 23 of the elastic insert 21 is in contact with the slanted bearing surface 24. During installation, when the upper surfaces 6 of the side-by-side floor panels 1, 1' are made flush with each other and when the installer continues to press the adjacent floor panel 1', then the bearing protrusion 27 causes the longitudinal coupling element 7 to be displaced downwardly, and by such bending the pressure of the upwardly extending vertical projection 11 onto the settling seat 16 is released, which consequently prevents the elastic insert 21 from engaging in the guiding groove 22.

Figure 6:
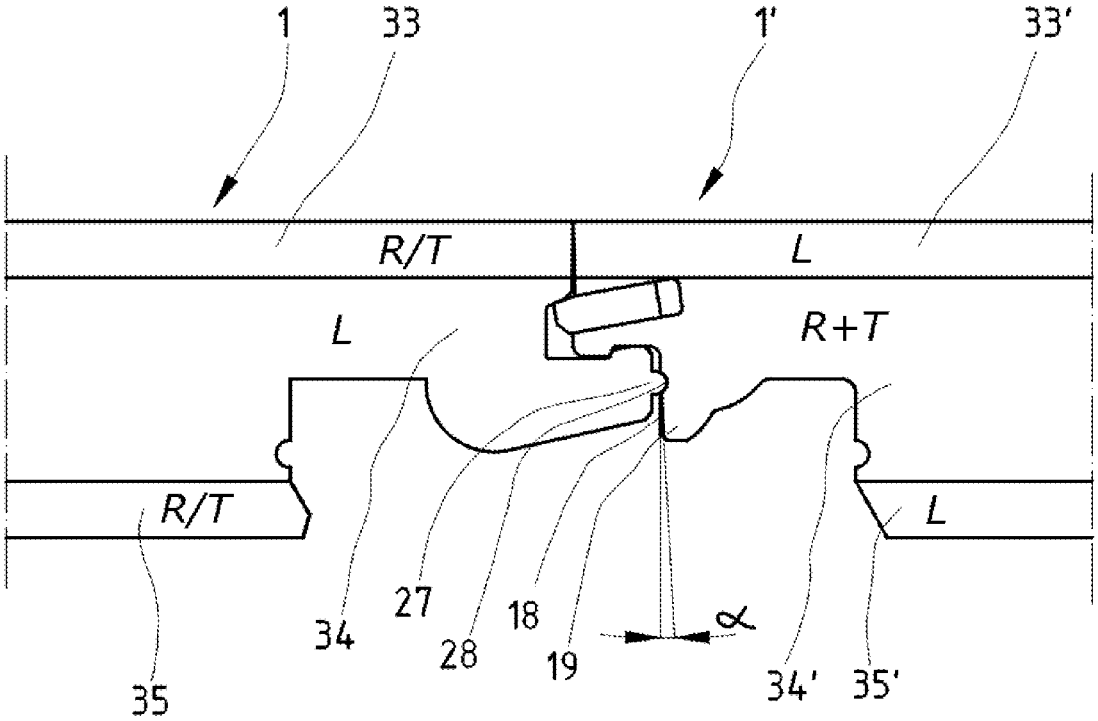
FIG. 6 floor panel joint as in FIG. 3, showing the orientation of the wood fibres.

FIG. 6 shows the orientation of the wood fibres in the individual layers of engineered wood floor panels 1, 1'. As shown in the embodiment, the floor panel 1 has: an upper layer 33 with wood fibres arranged in a radial R, tangential T or intermediate R/T direction; a middle layer 34 with wood fibres arranged in a longitudinal direction L; and a lower layer 35 with wood fibres arranged in a radial R, tangential T or intermediate direction R/T direction. In the case of the adjacent floor panel 1', the wood fibres of the upper layer 33' are arranged in the longitudinal direction L; of the middle layer 34' in the radial R, tangential or intermediate R/T direction, and of the lower layer 35' in the longitudinal direction L. As shown in the embodiment, the bearing surface 18 of the downwardly directed tongue 19 of the adjacent floor panel 1' is preferably inclined from the vertical by an angle equal to 3°, wherein equally good results in terms of facilitated guidance of the bearing protrusion 27 into the groove 28 of the adjacent floor panel 1' are obtained with an inclination of the bearing surface 18 within a range of 1° to 5°.

The use of the longitudinal bearing protrusion 27 placed partially in the groove 28 of the adjacent floor panel 1' is important in particular for floor panels 1, 1' made of wood and laid in herringbone or checkerboard patterns. In case of an increase in moisture, the forces acting between the joined floor panels 1, 1' are primarily transmitted through the lower layers 35, 35' and the middle layers 34, 34' and it is these layers that cause the greatest mutual pressure. In the solution according to the invention, the longitudinal bearing projection 27 placed partially in the groove 28 of the adjacent floor panel 1' bears the main part of the pressure forces and thus protects the upper surface 6 of the floor panels 1, 1' from damage.

Figure 7:
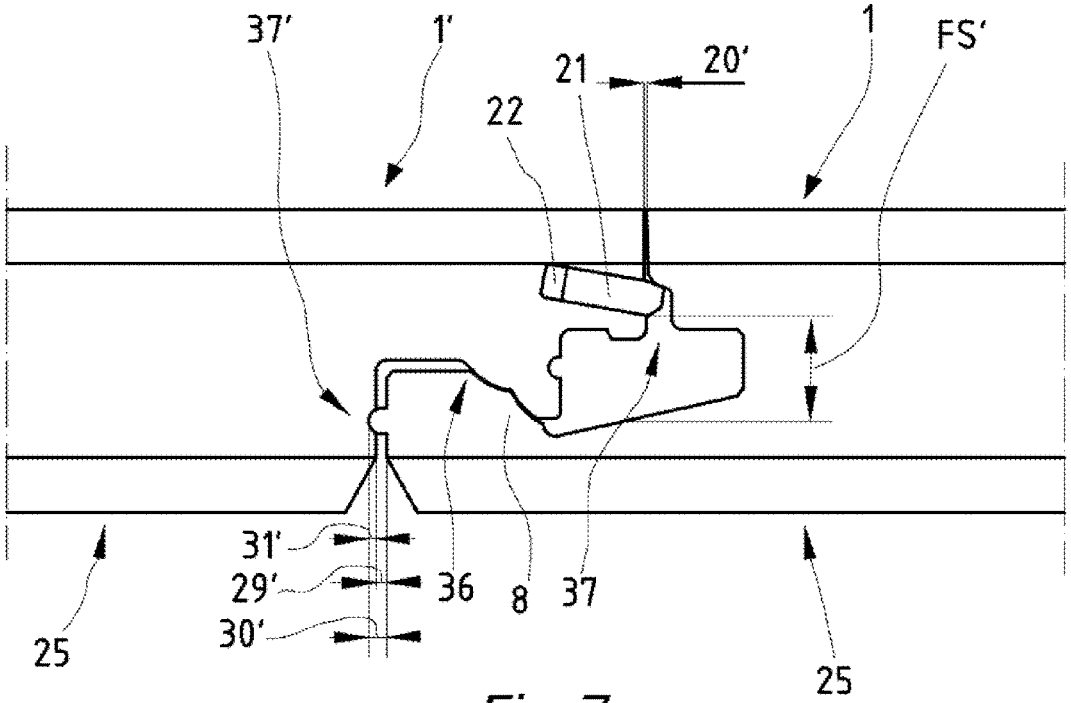
FIG. 7 another embodiment of the floor panel joint.
Figure 8:
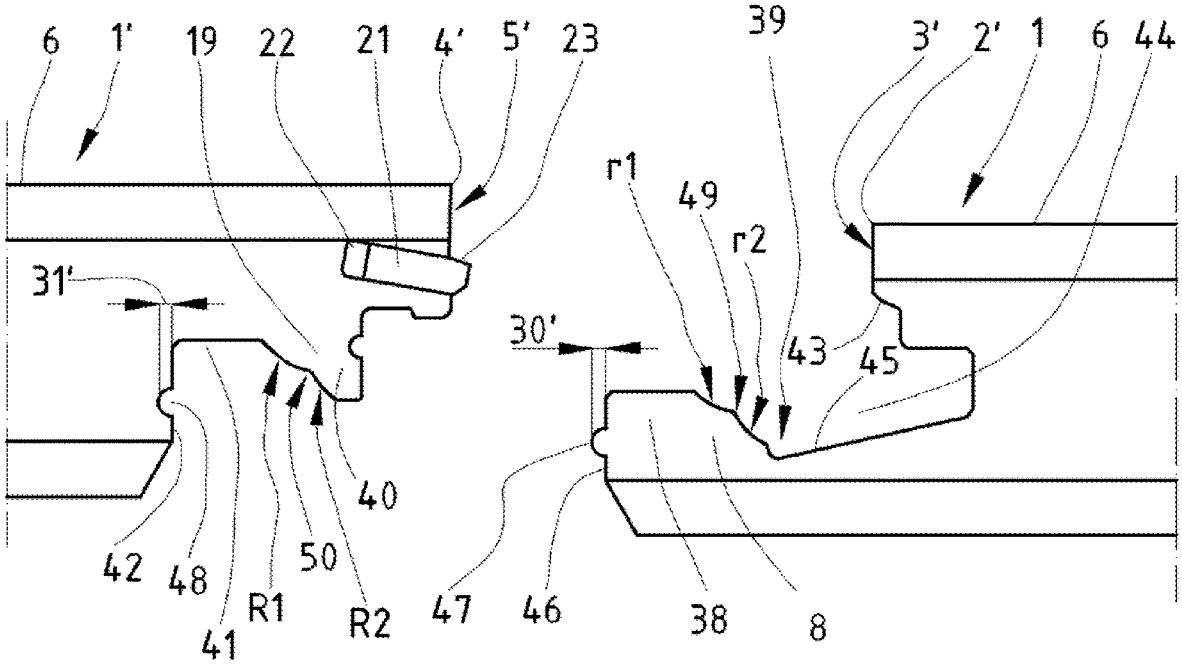
FIG. 8 floor panel joint from FIG. 7 in a disjoined position.

FIG. 7 and FIG. 8 show a joint of the floor panels 1, 1' laid perpendicularly in which the long edge 2' of the floor panel 1 is joined to the short edge 4' of the adjacent floor panel 1'. The joining of these floor panels 1, 1' is carried out by the horizontal retaining assembly 36 and the first vertical retaining assembly 37.

The horizontal retaining assembly 36 is formed by an upwardly extending vertical projection 38 formed at the end of the longitudinal coupling element 8 of the floor panel 1. The vertical projection 38 forms a settling recess 39, located in the upper part of the longitudinal coupling element 8, adapted to receive a downwardly extending vertical projection 40 of the adjacent floor panel 1'. The settling recess 39 is limited by the upwardly extending vertical projection 38. In turn, the downwardly extending vertical projection 40 of the adjacent floor panel 1', located below the guiding groove 22 of the elastic insert 21, forms a settling seat 41 located between the vertical bearing surface 42 and the two convex arched surfaces R1, R2 of this adjacent panel 1'.

In the joined position of the floor panel 1 with the adjacent floor panel 1', as shown in FIG. 7, the horizontal retaining assembly 36 makes it possible to obtain a predetermined size of the upper expansion joint 20' between the long edge 2' of the side surface 3' and the short edge 4' of the side surface 5'.

The first vertical retaining assembly 37 of the floor panels 1, 1' to be joined is formed in this embodiment by the elastic insert 21 placed via sliding in the guiding groove 22 from the side surface 5'. The joining of the floor panels 1, 1' is carried out essentially by half-rotation with vertical pressing of the adjacent floor panel 1' in order to render flush the upper surfaces 6 of the adjacent floor panels 1, 1'. In the flush position, the upper part 23 of the elastic insert 21 extending from the guiding groove 22 remains in contact with a slanted bearing surface 43 located above a settling recess 44, with a free space FS remaining between the lower side of the elastic insert and a lower surface 45 of the settling recess 44. In this position, lower surfaces 25 of the joined floor panels 1, 1' are also aligned in a single plane.

The longitudinal coupling element 8 has a vertical retaining surface 46 from which a longitudinal bearing projection 47 having a heigh 30' protrudes, forming an integral part of the longitudinal coupling element 8. In the joined position of the floor panel 1 with the adjacent floor panel 1', the longitudinal bearing projection 47 is located partially in a groove 48 formed in the vertical bearing surface 42 of the adjacent floor panel 1', at a depth 31', thus forming a second vertical retaining assembly 37'. A lower expansion joint 29' is provided between the bearing surfaces 42, 46. In the joined position of the floor panels 1, 1', the lower expansion joint 29' is smaller than the height 30' of the longitudinal bearing protrusion 47, which is the result of placing the end part of the bearing protrusion 47 in the groove 48 of the adjacent floor panel 1'.

The longitudinal bearing protrusion 47 thus made, being an integral part of the longitudinal coupling element 8, intended to be settled in the groove 48 of the adjacent floor panel 1', constitutes the second vertical retaining assembly 37' of the floor panels 1, 1' to be joined. This configuration is also important for increasing the precision of joining of the floor panels 1, 1'.

In the embodiment shown in FIG. 7 and FIG. 8, the distance between the slanted bearing surface 43 and the lower surface 45 of the settling recess 44 is substantially greater than the thickness of the elastic insert 21, thereby creating a free space FS'. Settling the longitudinal bearing protrusion 47 in the groove 48 of the adjacent floor panel 1' and providing a free space FS between the elastic insert 21 and the lower surface 45 of the settling recess 44 allows a larger pressing force tolerance to be applied when joining the panels 1, 1'. When a higher pressing force is applied, the elastic insert 21 will not engage in the guiding groove 22, nor will it deform due to contact with adjacent surfaces. Such a design of the first vertical retaining assembly 37 ensures that increased frictional resistance of the elastic insert 21 does not develop in the guiding groove 22, allowing it to move and ensuring proper vertical retention of the floor panels 1, 1' to be joined.

The horizontal retaining assembly 36 is formed by an upwardly extending vertical projection 38 formed at the end of the longitudinal coupling element 8 of the floor panel 1. The vertical projection 38 forms the settling recess 39, located in the upper part of the longitudinal coupling element 8, adapted to receive the downwardly extending vertical projection 40 of the adjacent floor panel 1'. The settling recess 39 is limited by the upwardly extending vertical projection 38. In turn, the downwardly extending vertical projection 40 of the adjacent floor panel 1' forms a settling seat 41 located between the vertical bearing surface 42 and the two convex arched surfaces R1, R2 of this adjacent panel 1'.

The two convex arched surfaces R1, R2 of the downwardly extending projection 40 are adapted in shape to the two concave arched surfaces r1, r2 of the settling recess 39. An elongated hump 49 is formed at the contact point of the concave arched surfaces r1, r2, and a recess 50 is formed at the contact point of the convex arched surfaces R1, R2.

Figure 9:
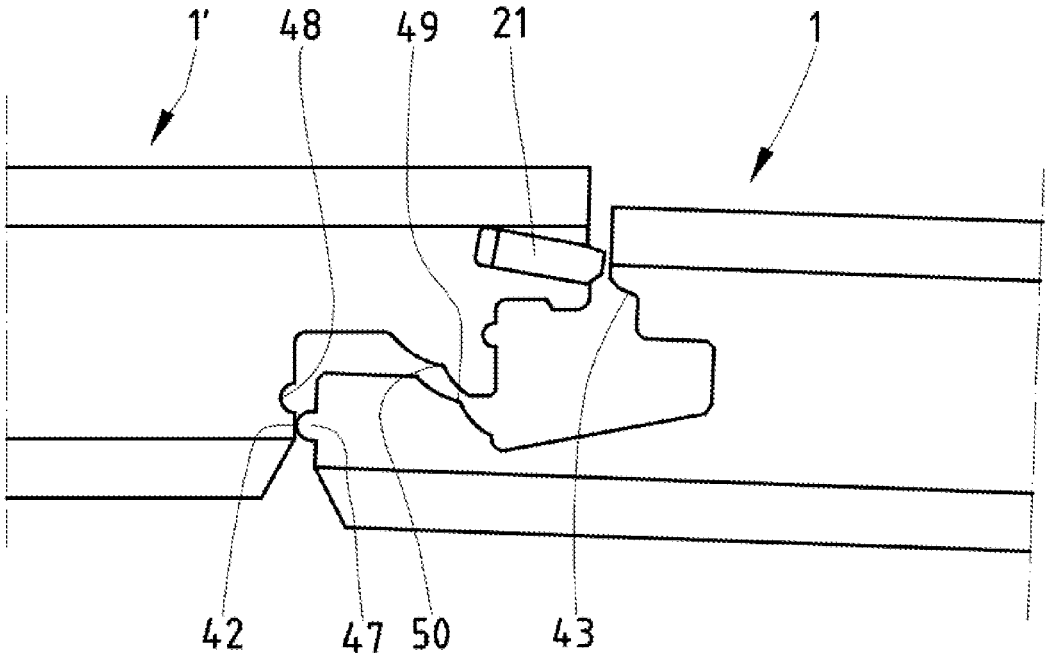
FIG. 9 floor panels from FIG. 8 in position during the joining operation.

As shown in FIG. 9, during installation of the panels 1, 1', the bearing projection 47 is guided by the lower part of the vertical bearing surface 42, whereby, in such an installation position, the guidance of the elastic insert 21 is facilitated. By guiding the bearing projection 47 into the groove 48 of the adjacent floor panel 1', the position shown in FIG. 7 is obtained in which the upper part 23 of the elastic insert 21 is in contact with the slanted bearing surface 43. In such a joined position, the elongated hump 49 enters the recess 50 which serves as an additional settling seat, causing additional stabilisation of the unambiguously made joint of the floor panels 1, 1'.

Figure 10:
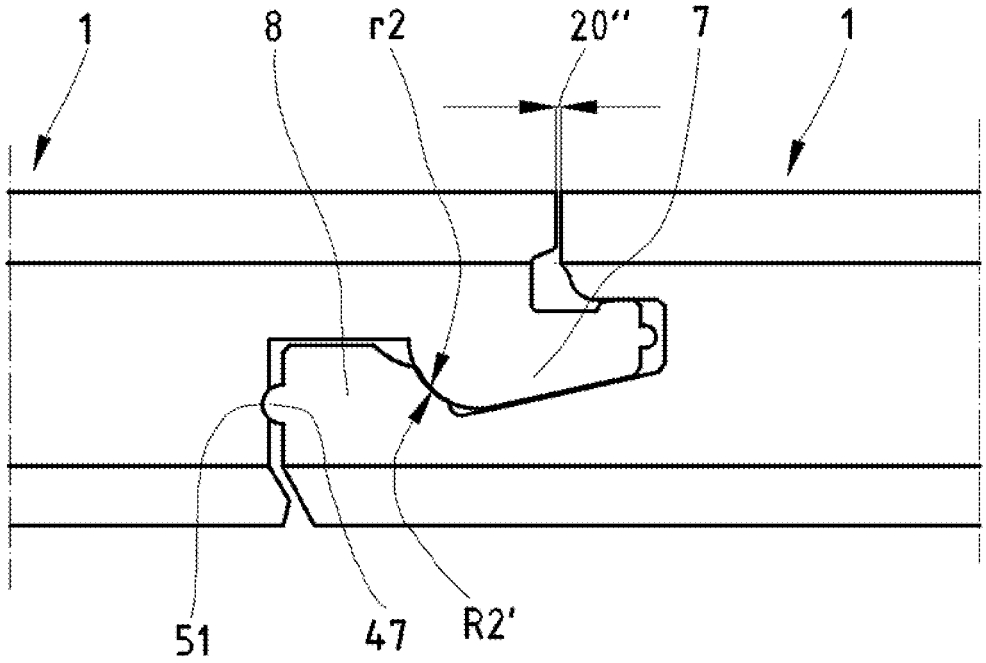
FIG. 10 floor panels in a joined position by coupling the longitudinal coupling elements together.

As shown in FIG. 10, the identical floor panels 1 are joined to each other by their long sides. In order to obtain such a joining, the longitudinal coupling element 7 of one long side of the floor panel 1 is joined to the second longitudinal coupling element 8 of the other side of the same floor panel 1. The vertical retention of such a joint is achieved by placing the end part of the longitudinal coupling element 7 in the settling recess 44, shown in FIG. 8. Additional vertical retention of such a joining is achieved by inserting the bearing projection 47 into a groove 51. The horizontal retention of the floor panels 1, between their long sides, is achieved by inserting the convex arched surface R2', of the longitudinal coupling element 7 into the concave arched surface r2 of this longitudinal coupling element 8, also with the use of the bearing projection 47 and the groove 51. Such a horizontal retention makes it possible to obtain a predetermined size of the upper dilatation gap 20" between the edges of the panels 1 to be joined.

The chosen terminology used herein is for informational purposes only and does not in any way limit the scope of the present invention. For example, t terms such as: "upper", "lower", "side", "middle", "vertical", "horizontal" or the like describe only the position shown in the Figures.

As follows from the above, the upper surface refers to the surface visible after laying the floor panels on the substrate, regardless of whether the floor panels are laid on the floor, on the wall or on the ceiling. The lower surface refers to the surface that is not visible after installation, regardless of whether the floor panels are laid on the floor, on the wall or on the ceiling, and intended to come into contact with the substrate.

Similar numbers on the Figures of the drawing refer to similar elements. The preferred embodiments disclosed in the Figures of the drawing and in the description, despite the use of specific terms, are only general in nature and should not be considered as limitations of the scope of the invention as defined in the following patent claims.

LIST OF REFERENCE NUMBERS

1, 1' Floor panel and identical adjacent floor panel;
2, 2' Long edge of the side surface of the floor panel;
3, 3' Side surface;
4, 4' Short edge;
5, 5' Side surface;
6 Upper surface of the floor panel;
7 Longitudinal coupling element;
8 Longitudinal coupling element;
9 Horizontal retaining assembly;
10 First vertical retaining assembly;
10' Second vertical retaining assembly;
11 Vertical projection;
12 Settling recess;
13 Vertical projection;
14 Vertical surface;
15 Slanted bearing surface;
16 Settling seat;

17 Slanted bearing surface;
18 Bearing surface;
19 Tongue;
20, 20', 20" Upper expansion joint;
21 Elastic insert;
22 Guiding groove;
23 Upper part of the guiding groove;
24 Bearing surface;
25 Lower surface of the floor panel;
26 Bearing surface;
27 Bearing projection;
28 Groove;
29 Lower dilatation gap;
30 Height of the bearing projection;
FS, FS' Free space between the elastic insert and the lower surface of the settling recess;
31, 31' Settling depth of the bearing projection;
32 Lower surface of the settling recess;
33, 33' Upper layer;
R Radial direction of fibre arrangement;
T Tangential direction of fibre arrangement;
R/T Intermediate direction of fibre arrangement;
34, 34' Middle layer;
35, 35' Lower layer;
α Angle of inclination of the bearing surface;
36 Horizontal retaining assembly;
37 First vertical retaining assembly;
37' Second vertical retaining assembly;
38 Vertical projection;
39 Settling recess;
40 Vertical projection;
41 Settling seat;
R1, R2 Convex arched surfaces;
42 Bearing surface;
43 Slanted bearing surface;
44 Settling recess;
45 Lower surface of the settling recess;
46 Bearing surface;
47 Bearing projection;
48 Groove;
r1, r2 Concave arched surfaces;
49 Elongated hump;
50 Recess;
51 Groove;
R2' Convex arched surface of the longitudinal coupling element.

The invention claimed is:

1. A joint of floor panels (1, 1'), including a floor panel and an adjacent floor panel, wherein each of the floor panels (1, 1') to be joined is in a form of a rectangular plate, comprising an upper surface (6) and a lower surface (25) parallel to the upper surface (6), intended to be laid on a substrate, two long edges (2, 2') of side surfaces (3, 3'), two short edges (4, 4') of side surfaces (5, 5'), a first vertical retaining assembly (10, 37) for the floor panels (1, 1') to be joined, in a form of an elastic insert (21) placed between the floor panels (1, 1') to be joined, a longitudinal coupling element (7, 8) shaped below one of the long edges (2) of the side surface (3), wherein the longitudinal coupling element (7, 8) is parallel to the upper surface (6) and extends horizontally beyond the upper surface (6), and furthermore, the longitudinal coupling element (7, 8) has a settling recess (12, 39) that couples with a downwardly extending projection (13, 40) of the adjacent floor panel (1') and forms with the adjacent floor panel a horizontal retaining assembly (9, 36) of the floor panels (1, 1') to be joined, wherein the longitudinal coupling element (7, 8) has a bearing surface (26, 46) at the end of longitudinal coupling element (7, 8), wherein the bearing surface (26, 46) is remote from a bearing surface (18, 42) of the adjacent floor panel (1'), and furthermore, a bearing projection (27, 47) is placed between the bearing surfaces (26, 46; 18, 42) and forms a second vertical retaining assembly (10', 37'), and defines a lower expansion joint (29, 29'), wherein the floor panel (1) is joined by the respective long edge (2, 2') to the short edge (4, 4') of the adjacent floor panel (1') by means of the first vertical retaining assembly (10, 37) in the form of an elastic insert (21), placed via sliding in a guiding groove (22) between the floor panels (1, 1') to be joined and extending from the side surface (5, 5') below the short edge (4)

and by means of a second vertical retaining assembly (10', 37'), placed below the first vertical retaining assembly (10, 37), in a form of a bearing protrusion (27, 47) extending from the bearing surface (26, 46), where bearing surface (27, 47) is positioned partially in a groove (28, 48) formed in the bearing surface (18, 42) of the adjacent floor panel (1'), the bearing protrusion (27, 47) being an integral part of the floor panel (1) and having a height (30, 30') greater than the size of the lower dilatation gap (29, 29'), and furthermore, the longitudinal coupling element (7, 8) has an upwardly extending vertical projection (11, 38) placed in a settling seat (16, 41) below the guiding groove (22) of the elastic insert (21).

2. The joint of the floor panels (1, 1') according to claim 1, wherein the bearing projection (27, 47) is in a form of a cylindrical section, and the groove (28, 48) of the adjacent floor panel (1') is adapted in shape to receive a part of the bearing projection (27, 47).

3. The joint of the floor panels (1, 1') according to claim 1, wherein the groove (28) is formed in a downwardly extending tongue (19) of the adjacent floor panel (1').

4. The joint of the floor panels (1, 1') according to claim 3, wherein the bearing surface (18) of the downwardly extending tongue (19) of the adjacent floor panel (1') is inclined from the vertical by an angle (a) between 1° and 5°.

5. The joint of the floor panels (1, 1') according to claim 1, wherein the downwardly extending projection (40) has two convex arched surfaces (R1, R2) matching two concave arched surfaces (r1, r2) of the settling recess (39).

6. The joint of the floor panels (1, 1') according to claim 5, wherein the two concave arched surfaces (r1, r2) form an elongated hump (49) at the contact point of the two concave arched surfaces (r1, r2) and the two convex arched surfaces (R1, R2) form a recess (50) at the contact point of the two convex arched surfaces (R1, R2), the elongated hump (49) being adapted in shape to the recess (50).

7. The joint of the floor panels (1, 1') according to claim 1, wherein the floor panel (1) has a slanted bearing surface (24, 43) above the settling recess (12, 44), intended for contacting the elastic insert (21), wherein the slanted bearing surface (24, 43) is positioned above a lower surface (32, 45) of the settling recess (12, 44) and a free space (FS, FS') is left between the lower side of the elastic insert (21) and the lower surface (32, 45) of the settling recess (12, 44).

* * * * *